US006701600B1

(12) United States Patent
Beierling

(10) Patent No.: US 6,701,600 B1
(45) Date of Patent: Mar. 9, 2004

(54) METHOD AND DEVICE FOR MACHINING CYLINDRICAL HOLLOW BODIES

(76) Inventor: Hans-Jürgen Beierling, Holtgrevenstrasse 22, D-33100 Paderborn (DE)

( * ) Notice: Subject to any disclaimer, the term of this patent is extended or adjusted under 35 U.S.C. 154(b) by 0 days.

(21) Appl. No.: 09/674,848

(22) PCT Filed: Mar. 8, 2000

(86) PCT No.: PCT/DE00/00729

§ 371 (c)(1),
(2), (4) Date: Feb. 12, 2001

(87) PCT Pub. No.: WO00/53348

PCT Pub. Date: Sep. 14, 2000

(30) Foreign Application Priority Data

Mar. 8, 1999 (DE) ..... 199 10 063

(51) Int. Cl.[7] ..... B23P 11/00
(52) U.S. Cl. ..... 29/430; 29/429; 29/557
(58) Field of Search ..... 29/430, 557, 558, 29/429, 457, 521, 773; 72/92, 94; 413/73, 75, 76

(56) References Cited

U.S. PATENT DOCUMENTS 2,407,776 A * 9/1946 Gladfelter et al. ..... 72/94
2,424,581 A * 7/1947 Peters ..... 72/94
2,686,551 A * 8/1954 Laxo ..... 72/93
2,928,454 A * 3/1960 Laxo ..... 72/94
4,246,770 A * 1/1981 Franek et al. ..... 72/92
4,671,093 A * 6/1987 Dominico et al. ..... 72/133
4,783,982 A * 11/1988 Hahn et al. ..... 72/55
5,150,594 A 9/1992 Pazzaglia
5,261,261 A * 11/1993 Ramsey ..... 72/105
5,349,837 A * 9/1994 Halasz et al. ..... 72/94
5,722,149 A * 3/1998 Lesage et al. ..... 29/505

FOREIGN PATENT DOCUMENTS

| | | |
|---|---|---|
| CH | 668 732 | 1/1989 |
| DE | 27 38 946 | 11/1978 |
| EP | 0 356 269 | 10/1990 |

* cited by examiner

*Primary Examiner*—Gregory Vidovich
*Assistant Examiner*—Stephen Kenny
(74) *Attorney, Agent, or Firm*—Browdy and Neimark, P.L.L.C.

(57) ABSTRACT

The invention relates to a method for producing or machining a work piece in the form of a cylindrical hollow body, especially a container (an outer wall of a container), a barrel or a cask. According to the inventive method, the work piece is held so that the longitudinal axis thereof is oriented vertically and is then machined, especially formed, edged and provided with beads, a bottom and a lid. The method is characterised in that the work piece is moved at the transfer level and is lowered into a working area of a machining device, especially a shaping machine, for machining. The machining device is arranged underneath the transfer level.

7 Claims, 5 Drawing Sheets

METHOD AND DEVICE FOR MACHINING CYLINDRICAL HOLLOW BODIES

CROSS REFERENCE TO RELATED APPLICATION

Figure 1:
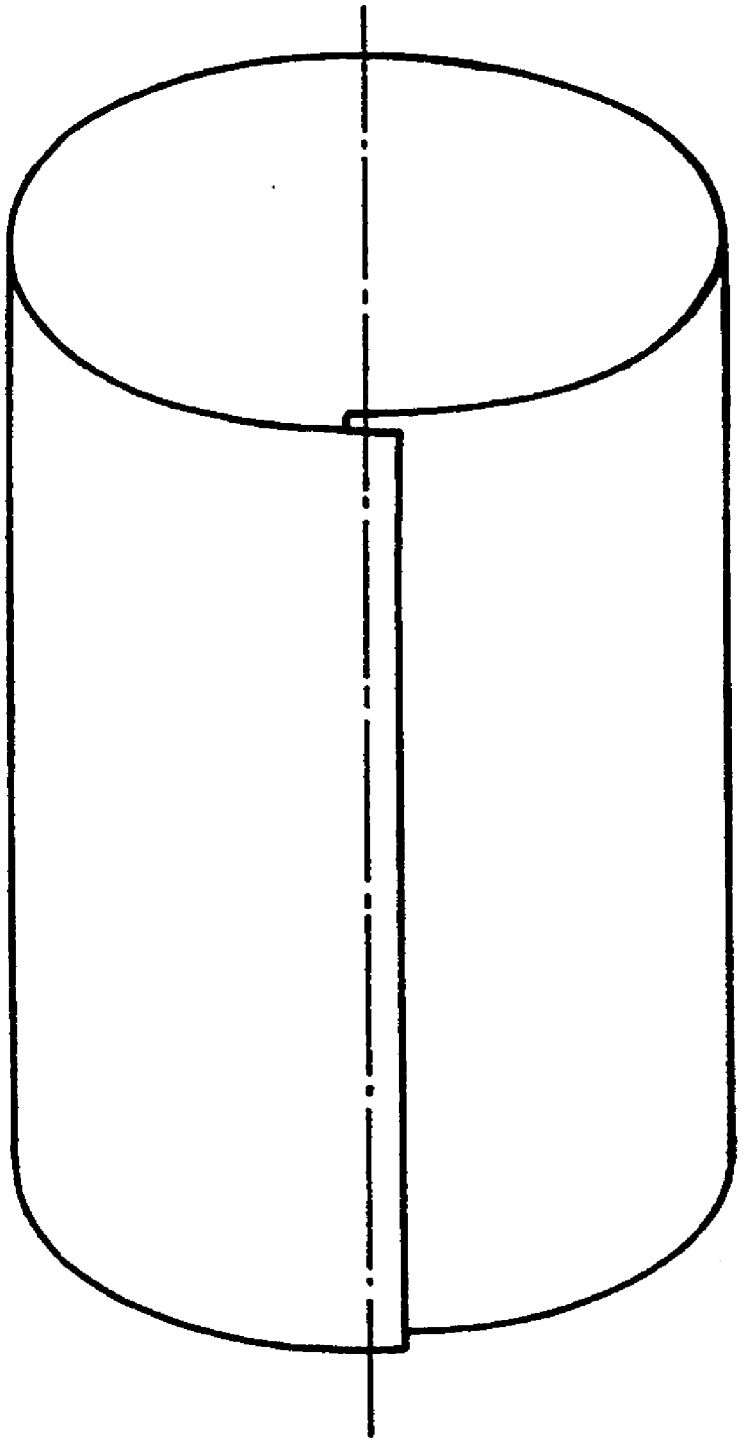

The present application is the national stage under 35 U.S.C. 371 of PCT/DE00/00729, filed Mar. 8, 2000.

The present invention relates to a method for producing or machining a work piece in the form of a cylindrical hollow body, especially a container (a wall of a container), a barrel or a cask, whereby the work piece is held such that the longitudinal axis thereof is oriented vertically and then machined in this orientation, especially formed, edged, and provided with beads, a bottom and a lid. The invention furthermore relates to a device for producing or machining a work piece in the form of a cylindrical hollow body, especially a container (a wall of a container), a barrel or a cask, having a transfer apparatus for moving the work piece, and a machining apparatus for producing or machining the work piece, especially an apparatus for forming, edging and providing with beads, a bottom and a lid, and with means for holding the work piece during the machining process in an orientation in which the longitudinal axis of the work piece is oriented vertically. The machining takes place on one or more, or preferably simultaneously on both front edges of the work piece. The machining may consist of grooving, edging or attaching a lid or bottom. For example, a drum-shaped metal shell or a wall of a container serving as a packaging container for any random filled-in contents with a loosely inserted bottom and lid may be firmly closed, with the closing process consisting of cold forming or warm forming in such a way that projecting metal edges are connected to one another, or formed and folded together.

In devices according to the preamble, in which the center axes of the work pieces are oriented vertically during the production or processing or forming, a transportation or transfer line is located underneath the machining apparatuses in such a way that the work pieces that are to be machined are moved by the transportation apparatus or by hand into the working area of the tools that are arranged or hanging above it.

The known method has the shortcoming that the heavy tools and drive assemblies must be mounted to portals having the appropriate load capacities, which results in considerable expenditures.

It is the object of the present invention to render a method according to the preamble, or a corresponding device, simpler and more cost effective.

With regard to method, this object is met in a method according to the preamble in such a way that the work piece is moved within a transfer level and lowered into a working area of a machining apparatus, especially a forming machine, that is arranged underneath the transfer level, for the machining process. This permits the heavy drive assemblies and forming tools to be mounted advantageously near the ground, while a light-weight transfer apparatus for moving the work pieces is located above them.

The work piece is lowered for the machining process with its longitudinal axis oriented vertically, and moved within the transfer level with its longitudinal axis oriented vertically. The work piece may be machined in the machining apparatus from the inside and/or from the outside. The work piece may be machined in the machining apparatus along its entire axial length or along a portion thereof. The work piece may be lowered and machined in stages.

The work piece may be lifted after a machining step and moved back into the transfer level, with the work piece undergoing a number of machining steps (lowering, machining and lifting) in a plurality of machining apparatuses. The work piece may be moved past selected machining apparatuses without being machined. Work pieces or containers may be manufactured noncircular or conical, and work pieces may be manufactured of sheet metal, multilayered sized cardboard (fiber) or multilayered metal-plastic sheets.

With regard to the device, the object of the invention is met with a device according to the preamble that is characterized in that the transfer apparatus is arranged vertically above the machining apparatus and designed such that a work piece that is to be machined can be lowered into a working area of the machining apparatus. The transfer apparatus may move and/or lower the work piece with its longitudinal axis oriented vertically.

The machining apparatus advantageously machines the work piece from the inside and/or from the outside especially in such a way that it edges the work piece on both sides, or edges it on one side and flanges it on the other side. The machining apparatus preferably provides the work piece with rolled beads and/or reinforcing beads.

A plurality of machining apparatuses may be arranged in series.

Figure 2:
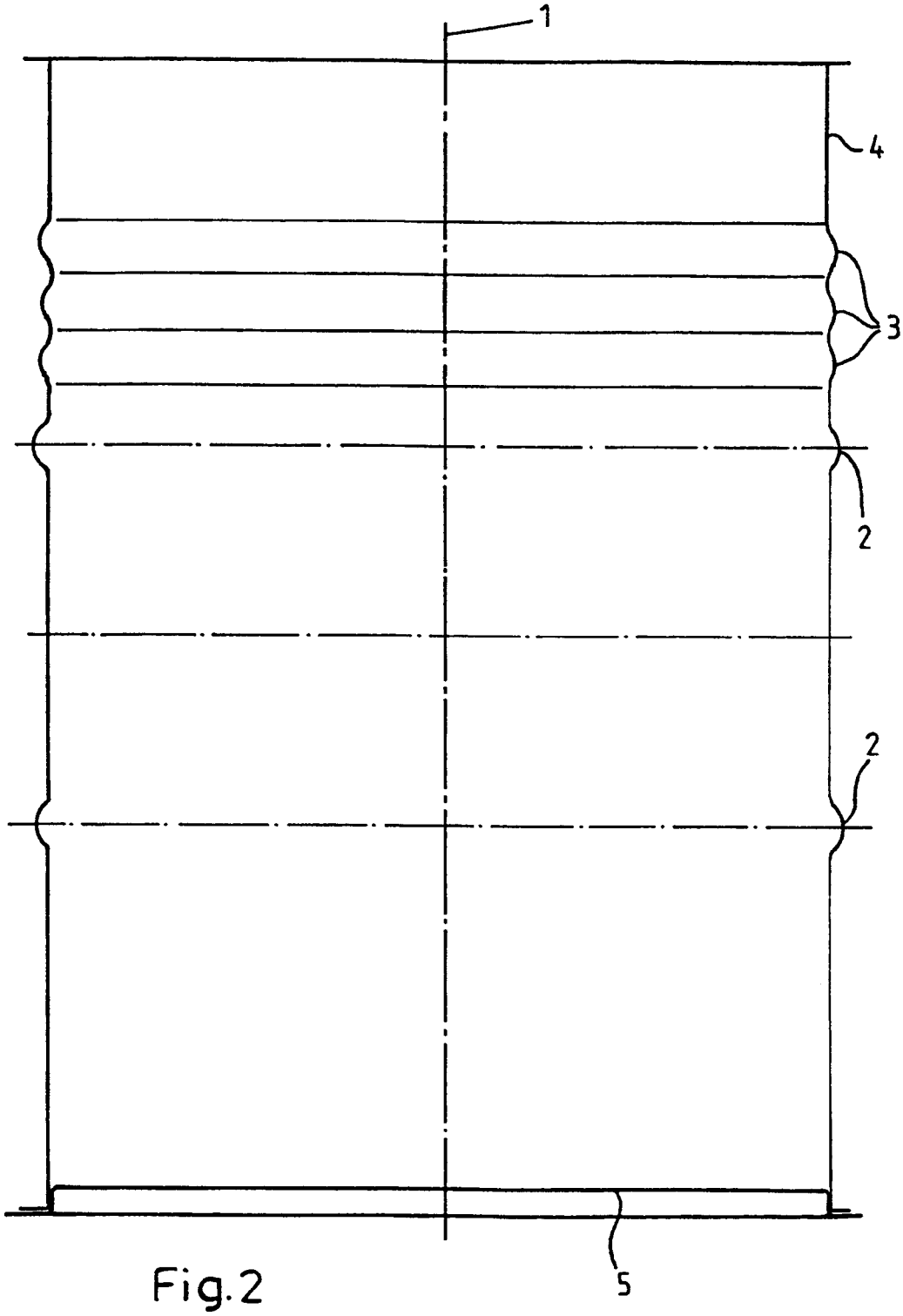
Figure 3:
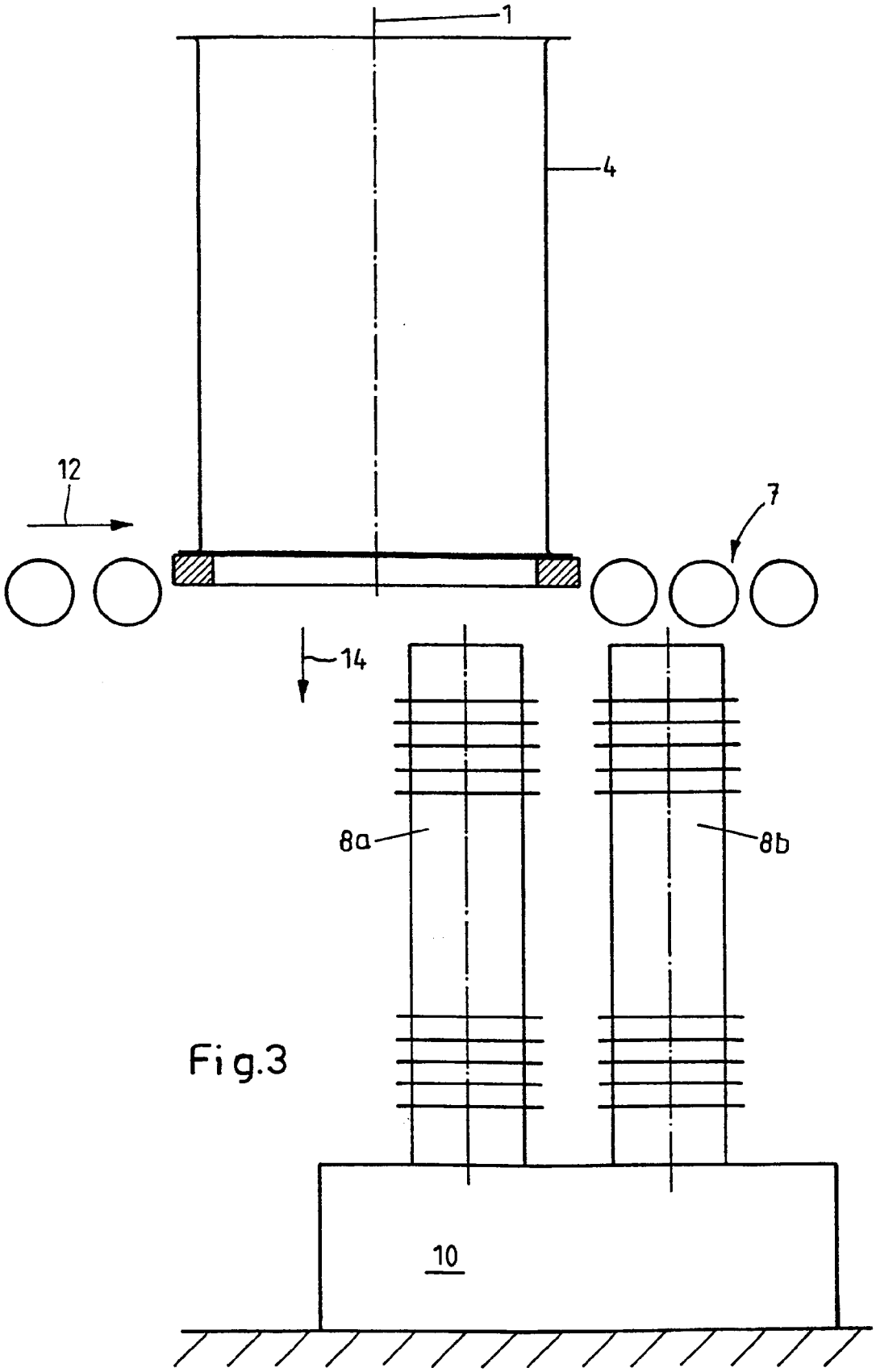
Figure 4:
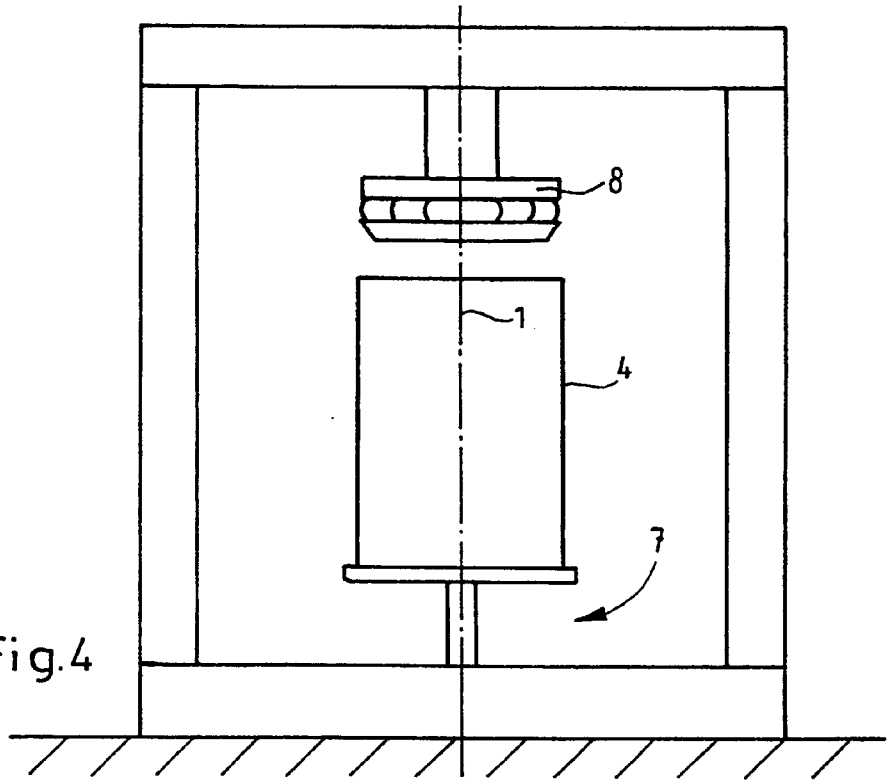
Figure 5:
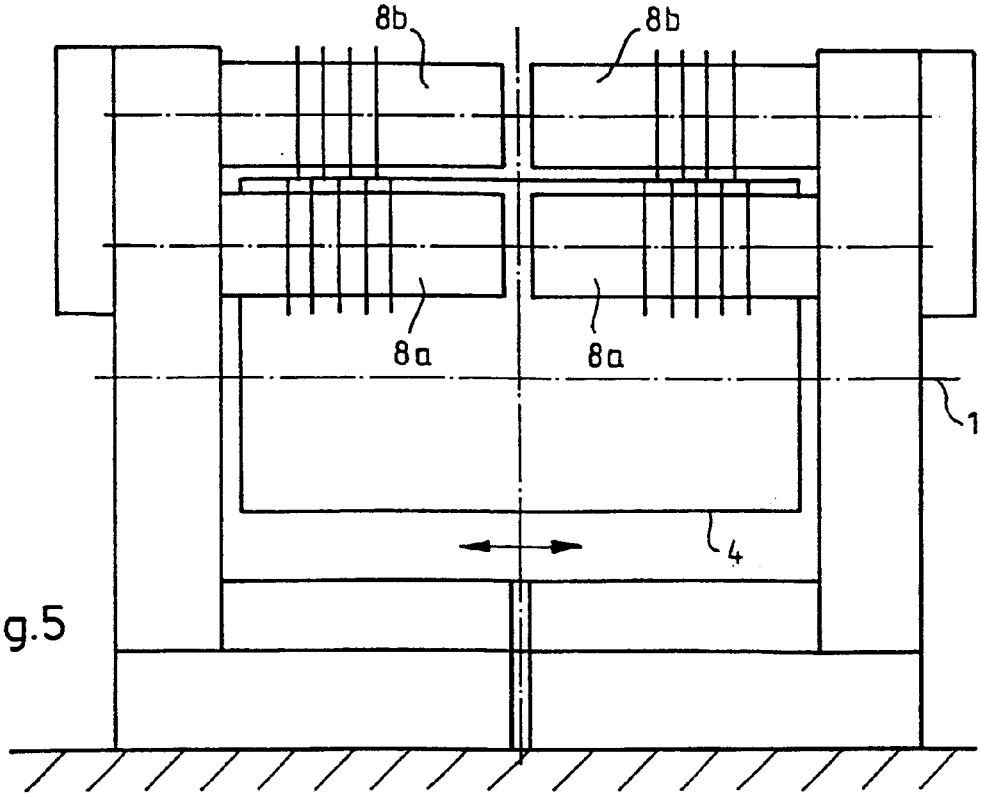
Figure 6:
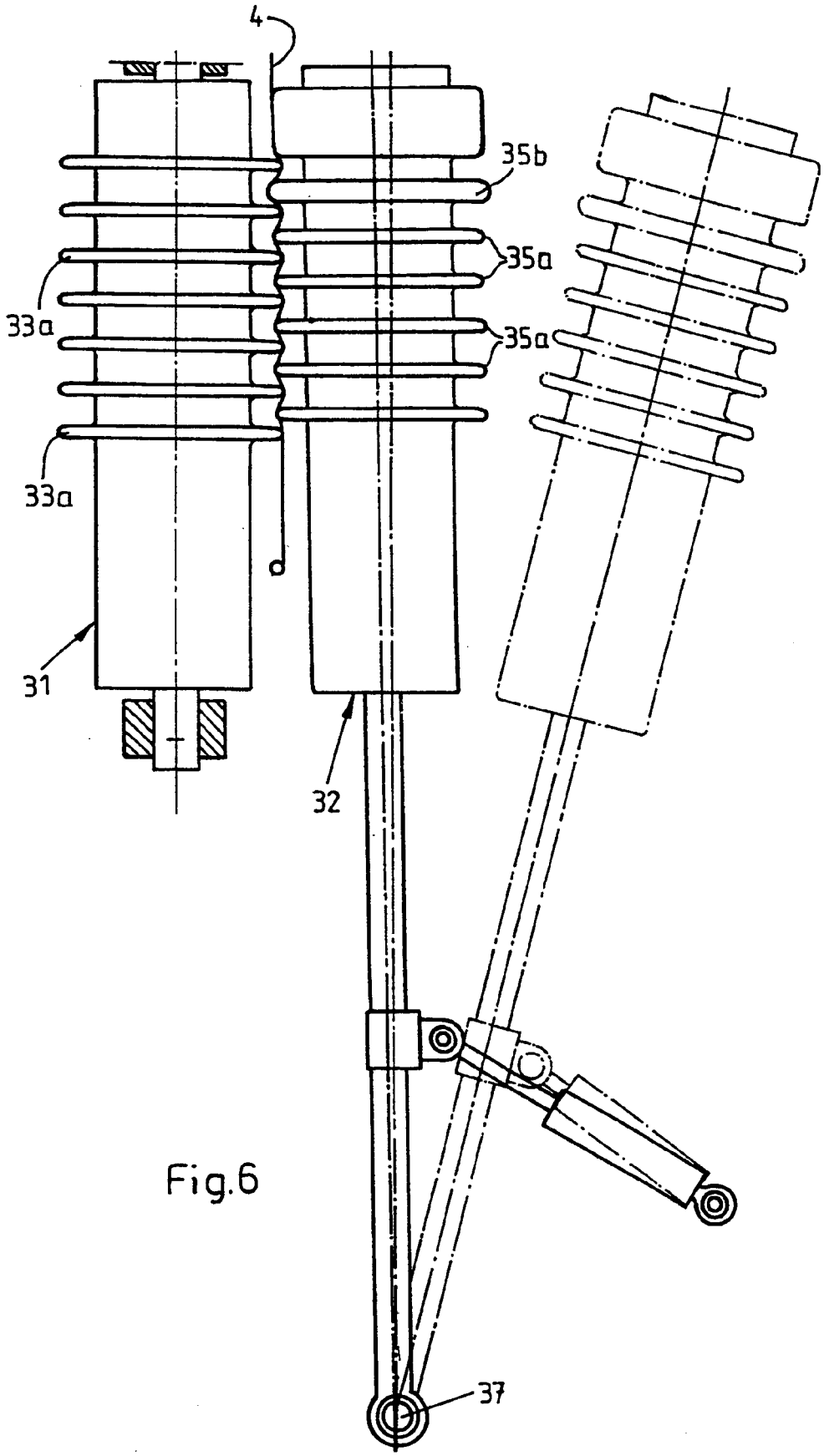

The invention will be explained in more detail below, based on a drawing in which:

FIGS. 1 and 2 serve to schematically illustrate a container that is to be machined;

FIG. 3 schematically shows an inventive device;

FIG. 4 schematically shows a known device wherein a work piece is machined with its longitudinal axis oriented vertically;

FIG. 5 schematically shows a known device wherein a cylindrical work piece is machined with the work piece axis oriented horizontally, and FIG. 6 is a top view of a known forming tool.

FIG. 1 shows a rounded wall of a container that is closed with a longitudinal weld or a longitudinal fold and may consist of sheet steel or some other sheet metal, but also of fiber (multilayered sized cardboard) or multilayered metal-plastic sheets. FIG. 2 shows a cylindrical container with a longitudinal axis 1 made from the container wall shown in FIG. 1, said container having a cylindrical container wall 4 provided with rolled beads 2 and reinforcing beads 3, and a bottom 5.

FIG. 4 shows, in a schematic illustration, a container production machine, in which the center axis or longitudinal axis 1 of a container stands vertically during the forming or production, with the container wall 4 lifted, for the forming process, by a transfer apparatus 7 or by hand into the working area of a machining tool 8 hanging from a portal above the transfer apparatus.

FIG. 5 illustrates a further known manufacturing method for containers whereby a container wall 4 with a horizontal longitudinal axis 1 is machined, whereby tools 8*a* machine the container wall 4 from the inside, and tools 8*b* machine the container wall from the outside so that beads, for example, may be formed.

FIG. 3 explains the inventive method based on a device wherein the work pieces or the container walls 4 with the vertically oriented longitudinal axis 1 can be lowered by a transfer apparatus 7 between forming tools 8*a*, 8*b* arranged on a machine bed 10.

Depending on the shaping to be performed, the lowering may take place with the full length of the container wall, or in stages, via parts thereof. The drive assemblies and forming tools are located just above the ground, while the light-weight transportation or transfer apparatus 7 is arranged above the machine. A plurality of forming machines may be arranged in series, and the individual machines may be designed for a double-sided edging (upsetting of the edge), one-sided edging and flanging (rolling of the edge) on the other side, press-forming of any number of rolled beads in various positions on the container wall, roll forming of any random number of reinforcing beads in different positions, lock-seaming bottoms and/or lids, or welding on lids. The containers or container walls that are moved in the transportation direction (arrow 12) on the transfer apparatus 7 are lowered (arrow 14) over the tools of the given machines and, after the forming or machining, lifted back onto the transfer apparatus. Individual forming machines may be bypassed and skipped for the manufacture of different container or container wall shapes.

The container wall guide elements are simpler and less complicated in the inventive design (lowered forming level), and also permit the forming of non-circular or conical container walls.

FIG. 6 shows an example from the prior art (EP 0 356 269) for a design of the forming tools 8*a*, 8*b* used in the device. The device has a roller 32 and a counter roller 31, with the two rollers created complementary to one another and the counter roller 31 mounted stationary. The roller 32 is held pivotable around a pivot point 37. The outer surfaces of the rollers are assembled from a number of ring-shaped disks 33*a*, 35*a*, 35*b*.

List of Reference Numerals

| | |
|---|---|
| 1 | Longitudinal axis |
| 2 | Rolled bead |
| 3 | Reinforcing bead |
| 4 | Container wall |
| 5 | Bottom |
| 7 | Transfer apparatus |
| 8 | Machining tool |
| 8a, 8b | Machining tools |
| 10 | Machine bed |
| 12 | Transportation apparatus |
| 14 | Lowering apparatus |
| 31 | Counter roller |
| 32 | Roller |
| 33a, 35a, 35b | Ring-shaped disks |
| 37 | Pivot point |

What is claimed is:

1. A method for producing or machining a work piece in the form of a cylindrical hollow body (4), especially a container (a wall of a container), a barrel or a cask, whereby the work piece (4) is held such that the longitudinal axis (1) thereof is oriented vertically and then machined in this orientation, especially, formed, edged, provided with beads, a bottom and a lid, characterized in that the work piece (4) is moved within a transfer level and lowered into a working area of a machining apparatus, especially a forming apparatus (8*a*, 8*b*), for machining, that the work piece undergoes a plurality of machining steps (lowering, machining and lifting), one after the other, in a plurality of machining apparatuses, and that the work piece is moved past at least one selected machining apparatus without being machined.

2. A method for producing or machining a work piece in the form of a cylindrical hollow body (4), especially a container (a wall of a container), a barrel or a cask, whereby the work piece (4) is held such that the longitudinal axis (1) thereof is oriented vertically and then machined in this orientation, especially, formed, edged, provided with beads, a bottom and a lid, wherein:

the work piece (4) is moved within a transfer level and lowered into a working area of a machining apparatus, especially a forming apparatus (8*a*, 8*b*), for machining;

the work piece is machined in the machining apparatus (8*a*, 8*b*) from the inside and/or from the outside;

the work piece is lowered for machining with its longitudinal axis vertically oriented;

the work piece is moved within the transfer level with its longitudinal axis vertically oriented;

the work piece is lifted after one machining stage and moved back into the transfer level with its longitudinal axis vertically oriented; and the work piece undergoes a plurality of steps including lowering, machining and lifting, one after the other, in a plurality of machining apparatuses.

3. A method as defined in claim 2, characterized in that the work piece is machined in the machining apparatus along its entire axial length or along a portion thereof.

4. A method as defined in claim 2, characterized in that the work piece is lowered and machined in stages of different heights.

5. A method as defined in claim 2, characterized in that the work piece is produced of sheet steel or sheet metal, multilayered sized cardboard (fiber) or multilayered metal-plastic sheets.

6. The method defined in claim 2, performed by a transfer apparatus (7) for moving the work piece, and the machining apparatus for producing or machining the work piece, especially for forming, edging and providing with beads, a bottom and a lid, incorporating means for holding the work piece during the machining in an orientation with a vertical longitudinal axis (1), the transfer apparatus (7) being arranged vertically above the machining apparatus and designed such that the work piece (4) that is to be machined can be lowered into the working area of the machining apparatus (8*a*, 8*b*), wherein:

the transfer apparatus (7) moves and/or lowers the work piece (4) with its longitudinal axis vertically oriented; the machining apparatus (8*a*, 8*b*) machines the work piece (4) from the inside and/or outside, especially providing it with a double-sided edging or one-sided edging and flanging on the other side; and said plurality of machining apparatuses is arranged in series and the transfer apparatus (7) moves the work piece between each of those machining apparatuses by a lifting movement, a lateral movement and a lowering movement.

7. A device as defined in claim 6, characterized in that the machining apparatus (8*a*, 8*b*) provides the work piece (4) with rolled beads and/or reinforcing beads (2, 3).

* * * * *